US007506531B1

(12) United States Patent
Lendway, IV et al.

(10) Patent No.: US 7,506,531 B1
(45) Date of Patent: Mar. 24, 2009

(54) DIMPLE-FORMING TOOL FOR PROJECTION WELDING

(75) Inventors: Joseph M. Lendway, IV, Dryden, MI (US); Alexander D. Khakhalev, Troy, MI (US); Don Reams, Harrison Township, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/961,089

(22) Filed: Dec. 20, 2007

(51) Int. Cl.
*B21D 7/00* (2006.01)
*B21J 9/18* (2006.01)

(52) U.S. Cl. ..... 72/454; 72/414; 72/416; 29/751; 29/755

(58) Field of Classification Search ..... 72/370.1, 72/409.01, 412, 414, 416, 454, 453.15, 453.16; 29/283.5, 516, 751, 755
See application file for complete search history.

(56) References Cited

U.S. PATENT DOCUMENTS 2,431,935 A * 12/1947 Huck ..... 72/355.4
3,469,434 A * 9/1969 Davis ..... 72/452.2
4,158,955 A * 6/1979 Bustin ..... 72/414
4,286,372 A * 9/1981 Batcheller ..... 29/516
6,220,074 B1 * 4/2001 Montminy et al. ..... 72/454
7,013,699 B1 * 3/2006 Sperko ..... 72/409.19
7,131,310 B2 * 11/2006 Easterbrook et al. ..... 72/334

* cited by examiner

*Primary Examiner*—David B Jones

(57) ABSTRACT

A tool is provided for forming a dimple on the edge of a metal sheet to facilitate projection welding of the sheet to an adjacent metal sheet. A reversible drill motor has a housing and chuck. A mounting bracket clamps onto the housing and a base is attached to the mounting bracket. A frame is attached to the base and has spaced apart arms. A first dimple forming die is mounted on one of the arms and a second dimple forming die is slidably mounted on the other of the arms. A driveshaft has a threaded end engaged in a threaded aperture of the second dimple forming die and a drive end captured in the chuck. Rotation of the driveshaft in one direction advances the second dimple forming die toward the first dimple forming to form a dimple in a sheet edge interposed between the dies.

9 Claims, 4 Drawing Sheets

DIMPLE-FORMING TOOL FOR PROJECTION WELDING

FIELD OF THE INVENTION

The present invention relates to a tool for forming a dimple on the edge of a sheet metal panel, thereby forming a projection for a subsequent projection welding operation.

BACKGROUND OF THE INVENTION

It is well known in the manufacture as well as the repair of sheet metal articles to attach sheet metal panels together via a projection weld. In projection welding, a dimple is formed on one metal sheet and then a second sheet is abutted against the dimple of the first sheet. Electrodes are applied to the metal panels adjacent the location of the dimple and electric current is conducted between the panels to form an electric resistance weld.

The presence of the projection serves to concentrate the point of contact between the two metal panels so that an effective weld is formed.

In the manufacturing environment, the dimple is readily formed on the one metal sheet by including a dimple-forming feature in the metal stamping dies that are used to form the sheet.

The present invention relates to a handheld tool for readily forming dimples on the edge of a sheet metal panel and is particularly useful in vehicle body repair facilities, and in the broader construction and repair industries, where a series of dimples need to be formed on the edge of a metal panel in readiness for making a projection electric resistance weld between a pair of panels.

SUMMARY OF THE INVENTION

A tool forms a dimple on the edge of a sheet metal sheet to facilitate projection welding of the sheet to an adjacent metal sheet. The tool includes a reversible drill motor having a housing and adjustable rotating chuck, a mounting bracket for clamping onto the housing of the drill motor and a base attached to the mounting bracket. A frame is attached to the base and has spaced apart arms. A first dimple forming die is mounted on one of the arms and a second dimple forming die is slidably mounted on the other of the arms and has a threaded aperture therein. A driveshaft has a threaded end engaged in the threaded aperture of the second dimple forming die and a drive end captured in the adjustable chuck of the drill motor so that rotation of the driveshaft in one direction advances the second dimple forming die toward the first dimple forming die to form a dimple in a sheet edge interposed between the dies. Reversing the direction of rotation of the driveshaft in the other direction will withdraw the second dimple forming die away from the first dimple forming die.

Further areas of applicability of the present invention will become apparent from the detailed description provided hereinafter. It should be understood that the detailed description and specific examples, while indicating exemplary embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE EXEMPLARY EMBODIMENTS

The following description of certain embodiments is exemplary in nature and is not intended to limit the invention, its application, or uses.

Figure 1:
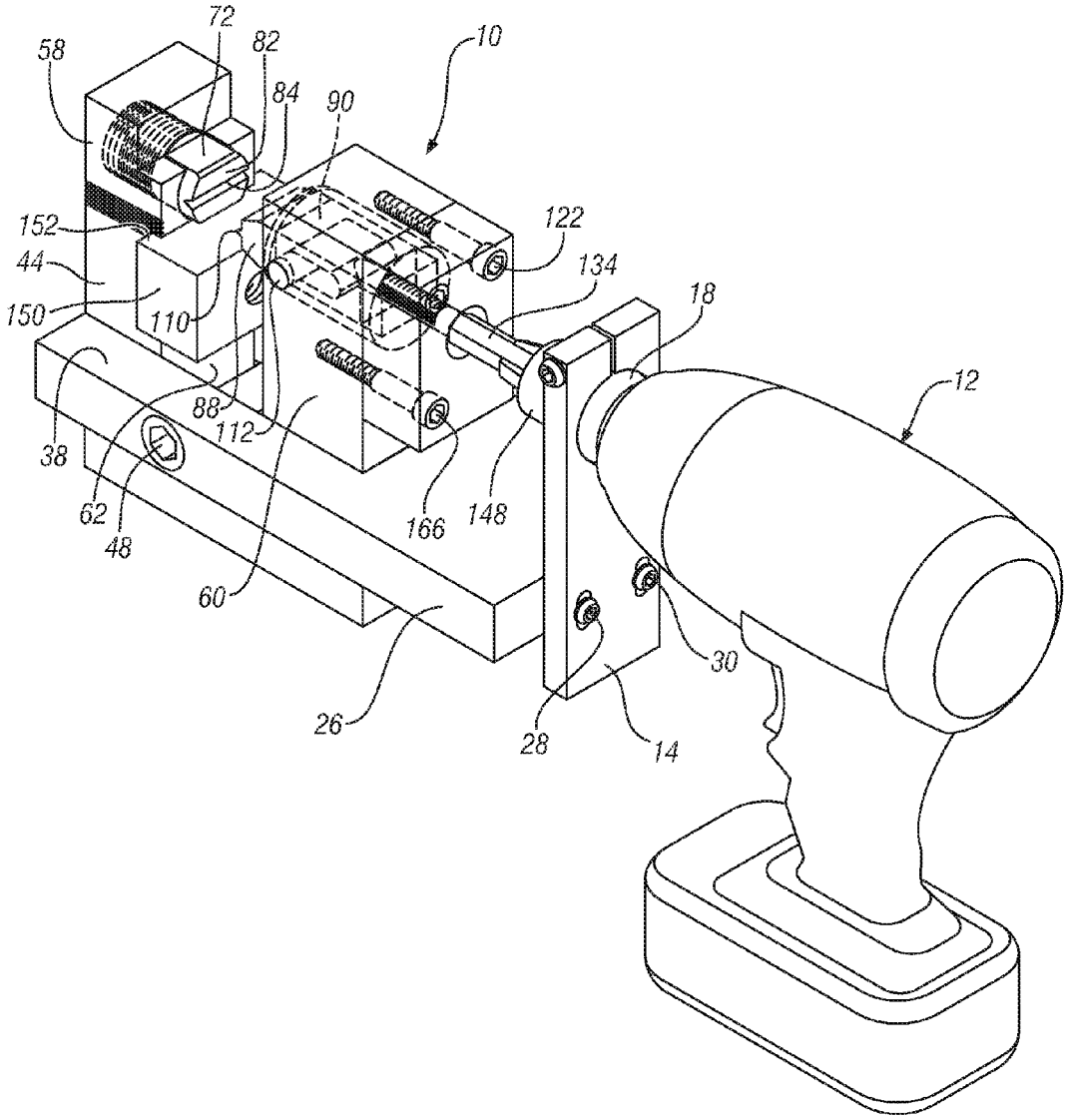
FIG. 1 is perspective view of the dimple-forming tool of the present invention mounted upon a reversible and rechargeable electric drill motor.
Figure 2:
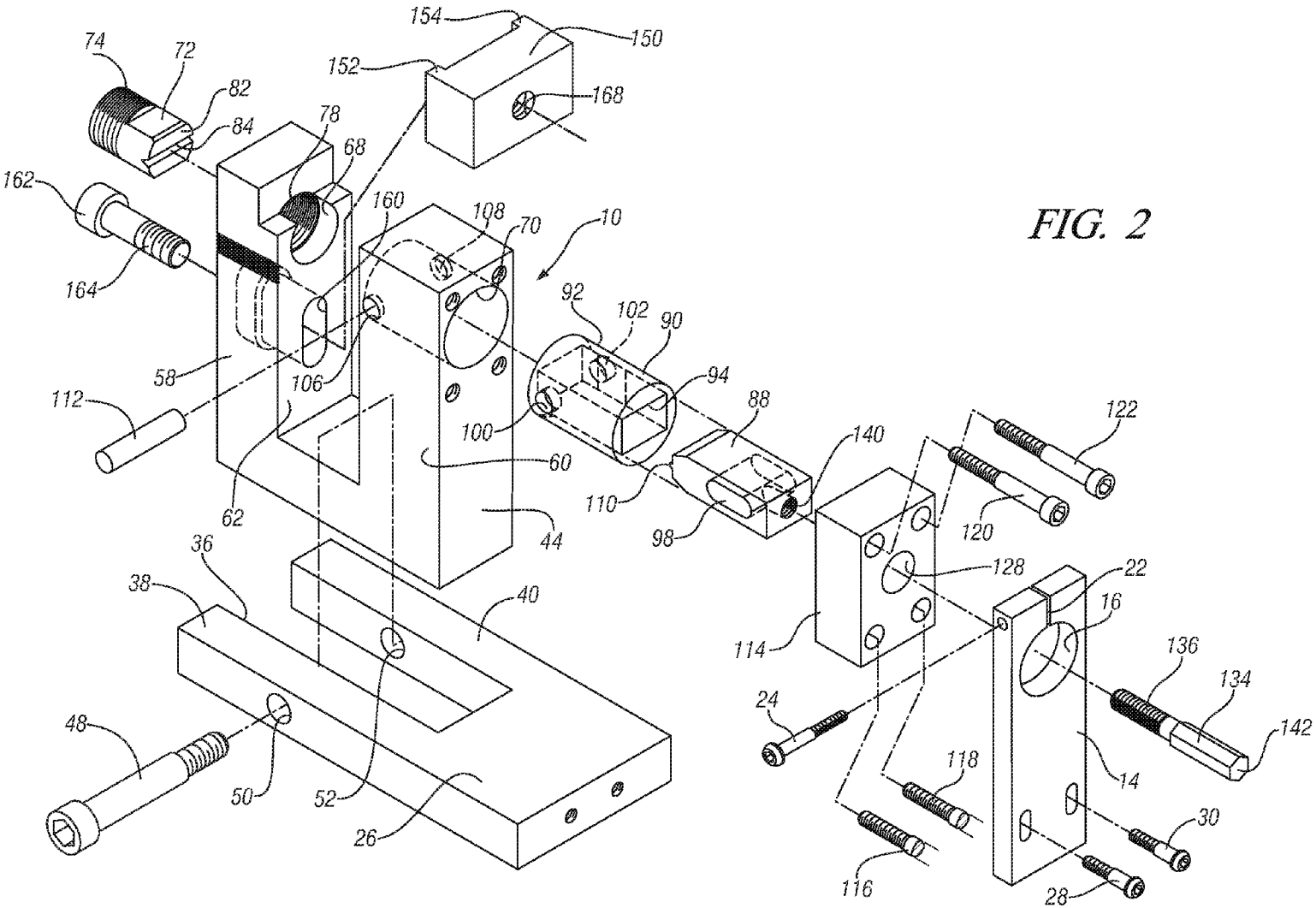
FIG. 2 is a perspective view of the tool having the parts thereof exploded.

Referring to FIG. 1, a dimple-forming tool generally indicated at 10 is mounted upon a reversible electric drill motor 12. Referring to FIGS. 1 and 2, it is seen that the tool 10 includes a mounting bracket 14 having an aperture 16 that fits over a cylindrical housing portion 18 of the electric drill 12.

Figure 3:
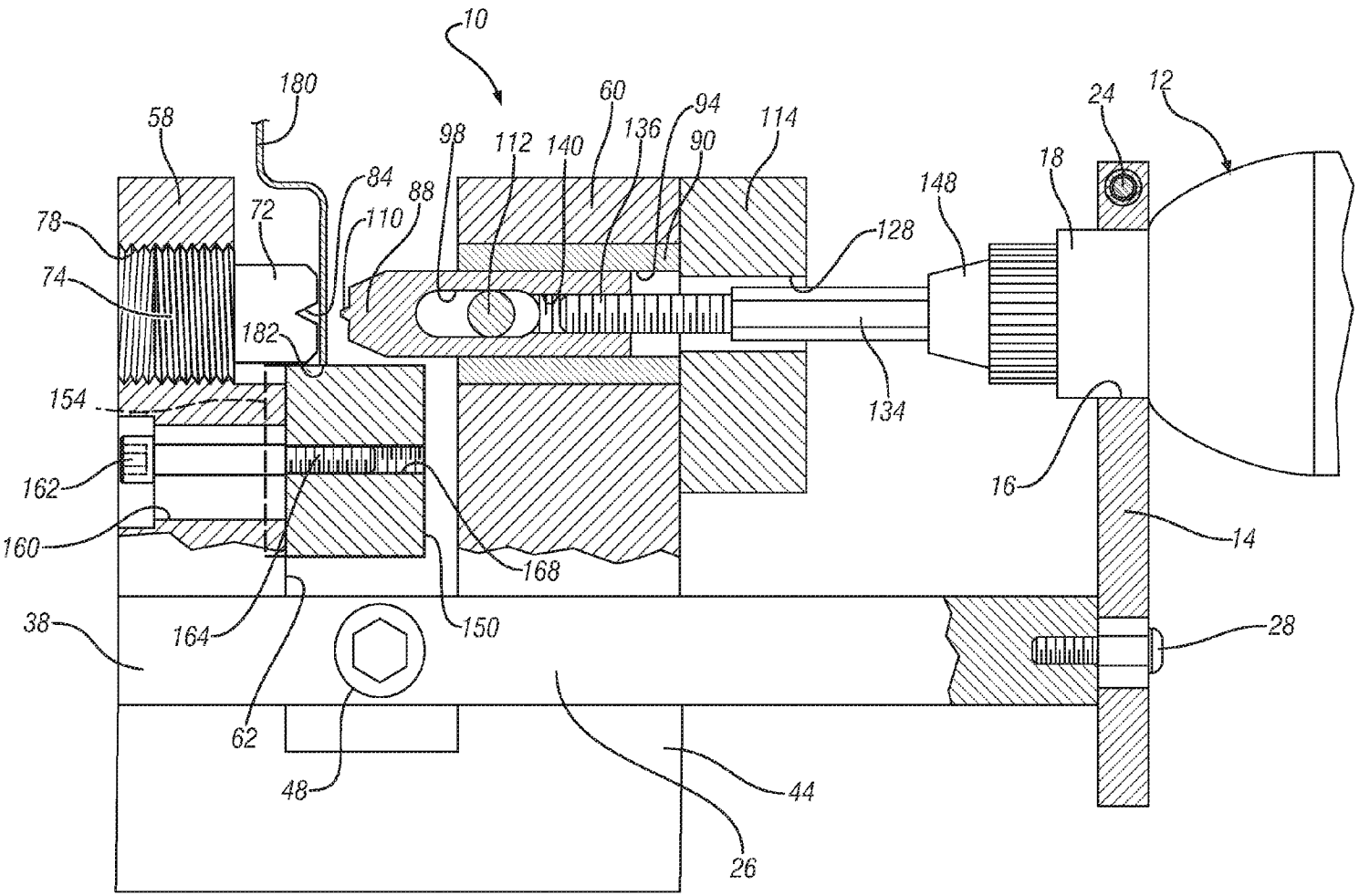
FIG. 3 is a side elevation view of the tool and drill of FIG. 1 with parts broken away and in section and showing the edge of a metal panel positioned between a fixed die and a movable die.
Figure 4:
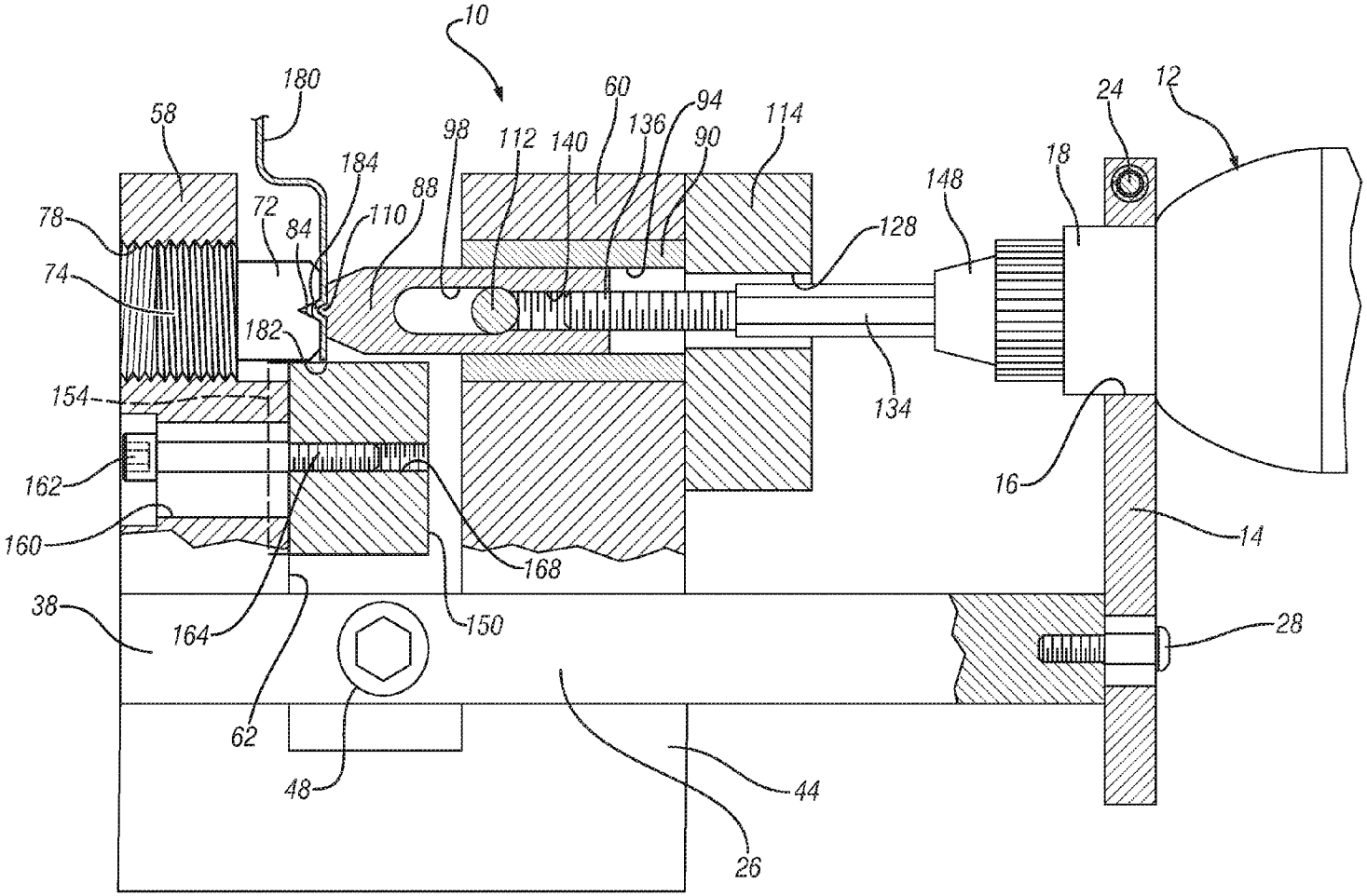
FIG. 4 is a side elevation view similar to FIG. 3 but showing the drill having advanced the movable tool so that a dimple has been formed on the edge of the sheet metal panel.

With regard to the following description, FIG. 2 shows the component parts of the tool exploded for clarity, and FIGS. 3 and 4 show the tool fully assembled but with parts broken away in section.

As seen in FIG. 2, the mounting bracket 14 has a slit 22 that intersects with the aperture 16. A screw 24 is installed through threaded apertures in the mounting bracket 14 to reach across the slit 22 and, when tightened, causes the mounting bracket 14 to be tightly secured on the housing portion 18 of the drill 12.

A tool base 26 is attached to the mounting bracket 14 by screws 28 and 30. The tool base 26 is generally rectangular in shape but has a central slot 36 defining spaced-apart legs 38 and 40. A U-shaped frame 44 includes a lower end that is captured within the slot 36 of the tool base 26 between the spaced-apart legs 38 and 40. A bolt 48 extends through an aperture 50 in the leg 38 and a threaded aperture 52 in the leg 40 so that tightening of the bolt 48 will clamp the U-shaped frame 44 to the tool base 26.

The U-shaped frame 44 has a left arm 58 and a right arm 60 spaced apart from one another by a slot 62. The left arm 58 has a bore 68 that is aligned with a bore 70 provided in the right arm 60. The left arm 58 has a female dimple die 72 mounted within the bore 68. The dimple die 72 has threads 74 by which the dimple die 72 can be threaded into corresponding threads 78 provided within the bore 68. The dimple die 72 has a die face 82 with a die cavity 84.

A male dimple die or punch 88 is movably mounted within the bore 70 of right arm 60 by a cylindrical die housing 90. The die housing 90 has a cylindrical outer surface 92 that fits within the bore 70 of the right arm 60. The die housing 90 has a central rectangular bore 94 that will receive the male dimple die 88. The male dimple die 88 has a transverse elongated slot 98 that aligns with apertures 100 and 102 provided in the die housing 90. The right arm 60 of the U-shaped frame 44 has apertures 106 and 108. The male dimple die 88 is inserted into the die housing 90 and the die housing 90 is in turn inserted into the bore 70 of the right arm 60. A retaining pin or bolt 112 is installed through the aligned apertures 106 and 108 of the right hand arm 60, and through the aligned apertures 100 and 102 of the die housing 90 and through the elongated slot 98 of the male dimple die 88. Accordingly, the dimple die 88 is slidably retained within the right arm 60 and permitted to advance and withdraw relative to the fixed female dimple die 72, as defined by the length of the elongated slot 98. Dimple die 88 has an elongated projection 110 at the leading edge thereof.

A retaining block 114 is attached to the right arm 60 by screws 116, 118, 120, and 122. The retaining block 114 has a bore 128 that aligns with the bore 70 of the right arm 60 and the mounting aperture 16 of the mounting bracket 14.

A driveshaft 134 has a threaded end 136 that is engaged within a threaded bore 140 of the male dimple die 88. The driveshaft 134 also has a hex-shaped end 142 that is gripped within an adjustable chuck assembly 148 of the electric drill 12.

An adjustable edge guide block 150 is captured within the slot 62 between the arms 58 and 60 of the U-shaped frame 44. As best seen in FIG. 2, the guide block 150 has retaining arms 152 and 154 that ride on the left arm 58. An elongated slot 160 is provided in the left arm 58 to receive a retaining bolt 162. Retaining bolt 162 has threads 164 that are received within a threaded bore 168 of the adjustable guide block 150. When the bolt 162 is loosened, the guide block 150 can be adjusted vertically up and down toward and away from the axis of the dimple forming dies 72 and 88 and the driveshaft 134 to an extent defined by the lengthwise elongation of the elongated slot 160. When the bolt 162 is tightened, the guide block 150 will be held in place against vertical up and down movement. By adjusting the guide block up and down, the dimple 184 can be formed at a precise location on the edge of the panel 180.

Referring now to FIG. 3, it is seen that the male dimple die 88 is withdrawn rightwardly away from the female dimple die 72. A sheet metal panel 180 has an edge 182 that is resting upon the guide block 150.

Referring to FIG. 4, the electric drill 12 has been energized to rotate the driveshaft 134 and thereby drive the male dimple die 88 leftwardly so that its projection 110 has displaced sheet metal into the corresponding cavity 84 of the female dimple die 72. In this way, a dimple 184 is formed on the sheet metal panel 180 in order to enable the subsequent making of a projection bond between the sheet metal panel 180 and another sheet metal panel, not shown.

Reversing the drill 12 will withdraw the movable dimple die 88 rightwardly so that the sheet metal panel 180 can be removed from the tool. Or alternatively, the tool can be moved away from the sheet metal panel 180.

In view of the foregoing, it will be appreciated that a dimple for projection welding can be readily formed on the edge of a sheet metal panel, and in particular, the tool hereof is particularly suited for use in a body repair shop in the automotive industry.

The description of the invention is merely exemplary in nature and, thus, variations thereof are intended to be within the scope of the invention.

What is claimed is:

1. A tool for forming a dimple on the edge of a sheet metal sheet to facilitate projection welding of the sheet to an adjacent metal sheet; comprising:

a reversible drill motor having a housing and adjustable rotating chuck;

a mounting bracket for clamping onto the housing of the drill motor;

a base attached to the mounting bracket;

a frame attached to the base and having spaced apart arms;

a first dimple forming die mounted on one of the arms;

a second dimple forming die slidably mounted on the other of the arms and having a threaded aperture therein;

a driveshaft having a threaded end engaged in the threaded aperture of the second dimple forming die and having a drive end captured in the adjustable chuck of the drill motor;

whereby rotation of the driveshaft in one direction to advance the second dimple forming die toward the first dimple forming die will form a dimple in a sheet edge interposed between the dies and then reversing the direction of rotation of the driveshaft in the other direction will withdraw the second dimple forming die away from the first dimple forming die.

2. The tool of claim 1 further comprising an edge guide block mounted on the frame and being engageable by the edge of the metal sheet to establish a location of the sheet metal edge relative to the dimple forming dies.

3. The tool of claim 2 further comprising the edge guide block being adjustably mounted on the frame for movement toward and away from the dimple forming dies to adjust the location of the sheet metal edge.

4. The tool of claim 3 further comprising an elongated slot receiving a retaining bolt that the edge guide block on the frame.

5. The tool of claim 1 further comprising the first dimple forming die being adjustably mounted on the frame.

6. The tool of claim 1 further comprising the second dimple forming die being slidably mounted within a bore provided in the frame.

7. The tool of claim 1 further comprising the frame being U-shaped with spaced apart arms having aligned bores therein, one bore having threads therein by which the first dimple die is mounted within the one bore, and the other bore slidably receives the second dimple forming die.

8. A tool for forming a dimple on the edge of a sheet metal sheet to facilitate projection welding of the sheet to an adjacent metal sheet, comprising:

a reversible drill motor having a housing and adjustable rotating chuck;

a mounting bracket for clamping onto the housing of the drill motor;

a base attached to the mounting bracket;

a U-shaped frame attached to the base and having spaced apart arms;

a first dimple forming die mounted on one of the arms;

a second dimple forming die slidably mounted on the other of the arms and having a threaded aperture therein;

an edge guide block mounted on the frame and being engageable by the edge of the metal sheet to establish a location of the sheet metal edge relative to the dimple forming dies; and a driveshaft having a threaded end engaged in the threaded aperture of the second dimple forming die and having a drive end captured in the adjustable chuck of the drill motor;

whereby rotation of the driveshaft in one direction to advance the second dimple forming die toward the first dimple forming die will form a dimple in a sheet edge interposed between the dies and then reversing the direction of rotation of the driveshaft in the other direction will withdraw the second dimple forming die away from the first dimple forming die.

9. The tool of claim 8 further comprising said edge guide block being adjustably mounted on the frame for adjusting movement on the frame for toward and away from the dimple forming dies to adjust the location of the sheet metal edge.

* * * * *